United States Patent [19]

Noguchi et al.

[11] Patent Number: 4,941,961

[45] Date of Patent: Jul. 17, 1990

[54] FLEXIBLE ELASTOMER ELECTRODE

[75] Inventors: Toru Noguchi; Toshimichi Takada; Takahiro Yonezaki; Yoshio Yamaguchi, all of Kobe; Hajime Kakiuchi, Itami; Shigehito Deki, Kobe; Kazuo Goto, Kobe; Hitoshi Miyata, Amagasaki; Satoshi Mashimo, Akashi, all of Japan

[73] Assignee: Mitsuboshi Belting Ltd., Nagata, Japan

[21] Appl. No.: 341,708

[22] Filed: Apr. 21, 1989

[30] Foreign Application Priority Data

| | | | |
|---|---|---|---|
| Apr. 21, 1988 | [JP] | Japan | 63-99960 |
| Jun. 17, 1988 | [JP] | Japan | 63-151038 |
| Dec. 13, 1988 | [JP] | Japan | 63-315503 |

[51] Int. Cl.[5] ..... C25B 11/12

[52] U.S. Cl. ..... 204/294; 204/280; 204/290 R; 204/291; 204/282

[58] Field of Search ..... 204/280, 286, 290 R, 204/291, 297, 282

[56] References Cited

U.S. PATENT DOCUMENTS

| | | | |
|---|---|---|---|
| 4,236,993 | 12/1980 | Muller et al. | 204/29.4 |
| 4,265,727 | 5/1981 | Beckley | 204/290 R |

FOREIGN PATENT DOCUMENTS

| | | | |
|---|---|---|---|
| 0026995 | 4/1981 | European Pat. Off. | 204/290 R |
| 127127 | 11/1978 | Japan . | |
| 259533 | 11/1987 | Japan . | |
| 3235492 | 9/1988 | Japan . | |

*Primary Examiner*—John F. Niebling
*Assistant Examiner*—Kathryn Gorgos
*Attorney, Agent, or Firm*—Wood, Phillips, Mason, Recktenwald & VanSanten

[57] ABSTRACT

An elastomeric electrode having an electrically conductive base, a protective layer enclosing the base formed of an elastomeric material having electrically conductive material selected from the group consisting of highly conductive carbon black, graphite, and glassy carbon distributed therein and present in the amount of 10 to 30 parts by weight to 100 parts by weight of the elastomeric material. A terminal extends from the base to exteriorly of the protective layer.

32 Claims, 3 Drawing Sheets

FIG. 6
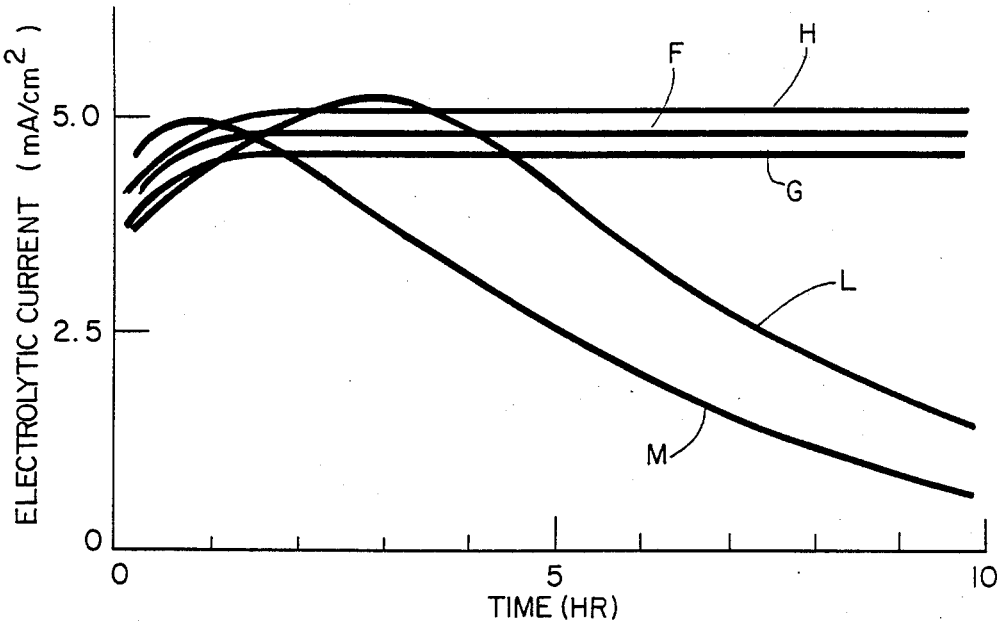
FIG. 7
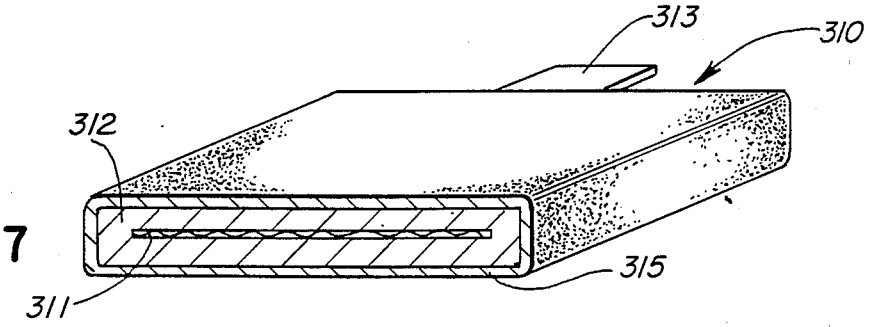
FIG. 8
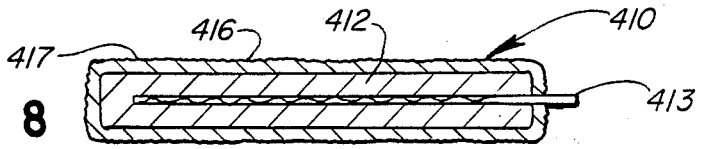
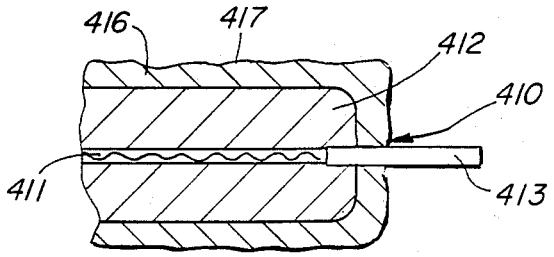
FIG. 9

FIG. 10
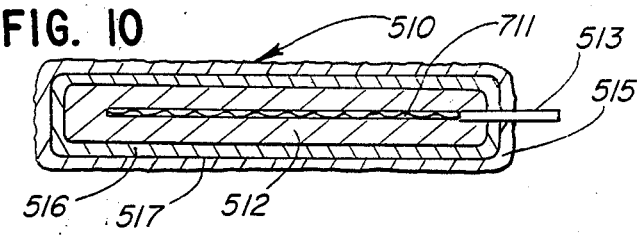
FIG. 11
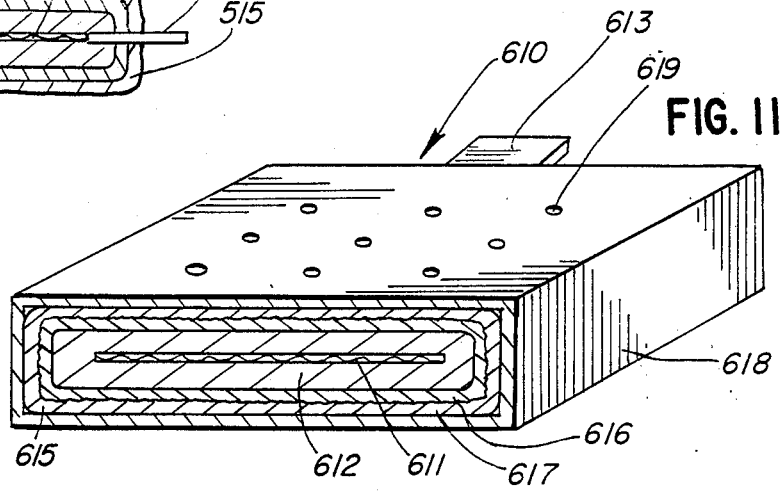
FIG. 12
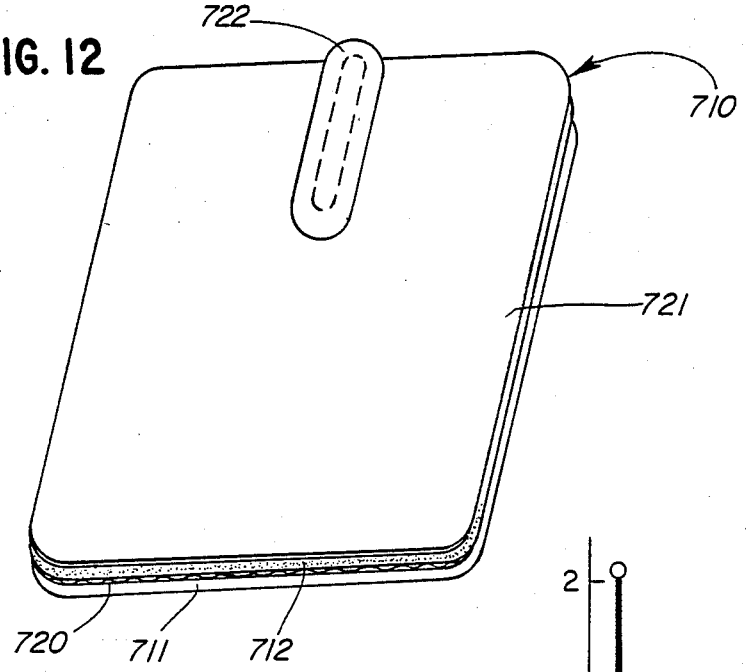
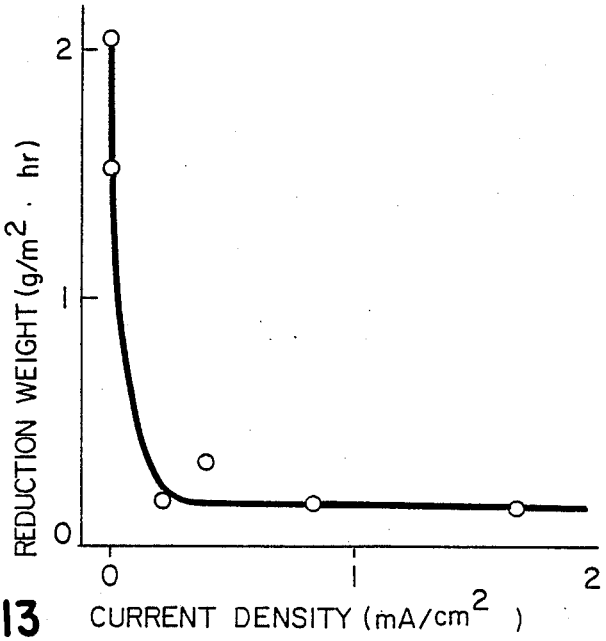
FIG. 13

FLEXIBLE ELASTOMER ELECTRODE

TECHNICAL FIELD

This invention relates to electrical conductors and, in particular, to electrodes.

BACKGROUND ART

In one conventional form of electrode, the electrode comprises a metal element having a suitable current-carrying wire connected thereto. The electrode illustrative may be disposed in an electrolytic bath, soil, etc. In such an application, when direct current is applied to the electrode, ionic conduction through the grounding medium relative to the electrode is effected.

Chemical changes occur at the boundary between the electrode and the surrounding medium. Illustratively, conventional uses of such electrodes are in electric plating, electric metallurgy, treatment of soils, such as to remove disease bacteria or microorganisms therefrom, electrolytic plating operations, etc.

In Japanese laid-open patent application Nos. 127127/1978 and 259533/1987, such electrodes are utilized in soil for removing specific diseased bacteria and microorganisms.

The use of metal or graphite electrodes presents the serious problem in the lack of durability due to oxidation of the surface of such electrodes, where the electrodes are used as anodes. Such oxidation causes contamination of the electrolyte and further causes disintegration of the anode, requiring replacement thereof in normal use.

Further, it is difficult to manufacture such metal or graphite electrodes in other than extremely simple shapes due to the high hardness thereof.

One attempted solution of the problem is to plate the electrodes with noble metal, such as platinum, gold, etc. Such attempted solution is not fully satisfactory because of the high expense thereof.

Graphite electrodes are subject to such oxidation, as well as the metal electrodes.

Further, soil particles adhering to the surface of the electrodes, or gas generated by the electrolytic reaction at the electrode cause a serious problem in the reduction of the current flow.

DISCLOSURE OF INVENTION

The present invention comprehends an improved electrode construction which avoids the problems of the above discussed prior art electrodes in a novel and simple manner.

The invention comprehends the provision of a composite elastomeric electrode adapted for use as an anode having long, troublefree life.

The elastomeric electrode of the invention has excellent flexibility.

The electrode construction effectively blocks corrosion of the surface thereof due to oxidation for improved use in electrolytic reaction, soil treatment, etc. Where used in the soil, the electrode provides improved resistance to adherence of soil thereto, and improved prevention of gas generation at the electrode while, at the same time, providing increased surface area for enhanced current efficiency.

The invention comprehends the provision of such an electrode having an elastomeric electrically conductive base enclosed in a protective elastomeric layer.

A terminal is provided for connecting the base to electrically conductive wires or the like.

The protective layer is formed of an electrically conductive elastomeric composition wherein electrically conductive carbon is distributed in a synthetic resin.

In the illustrated embodiment of the invention, the protective layer includes 10 to 30 weight parts of highly electrically conductive carbon having 300 to 600 ml/100 g of DBP absorption number, 800 to 2000 mg/g of iodine number, and 800 to 2000 $m^2/g$ of nitrogen surface area to 100 parts by weight of rubber.

In the illustrated embodiment, the rubber may comprise silicone rubber, fluorine rubber, etc.

The invention comprehends that the protective layer may contain antioxidative conductive powder, and, in the illustrated embodiment, the conductive powder is provided in an outer surface portion of the protective layer.

The surface portion illustrative contains a greater amount of highly electrically conductive material than the remainder of the protective layer.

The electrically conductive material of the protective layer may comprise highly conductive carbon black, graphite, glassy carbon, and the like.

The invention comprehends the provision of a filter layer of porous material on the outer surface of the protective layer.

The invention comprehends that the protective layer may have an outer surface which is irregular or uneven and that a filter layer may be provided on the irregular or uneven outer surface of the protective layer.

The invention further comprehends that the electrode may be mounted in a housing having an opening therein for passing the electrical terminal into electrical conductive contact with the base.

The electrode of the present invention is extremely simple and economical in construction, while yet providing the highly desirable features discussed above.

BRIEF DESCRIPTION OF THE DRAWING

Other features and advantages of the invention will be apparent from the following description taken in connection with the accompanying drawing wherein:

FIG. 6 is a graph showing the relationship between electrolytic current and time of a number of different examples of electrodes embodying the invention;

FIG. 7 is a fragmentary perspective sectional view of another form of electrode embodying the invention;

FIG. 8 is a transverse section of still another form of electrode embodying the invention;

FIG. 9 is a fragmentary enlarged sectional view illustrating a portion of the electrode of FIG. 8 in greater detail;

FIG. 10 is a transverse section showing still another embodiment of the invention;

FIG. 11 is a fragmentary perspective sectional view of still another electrode embodying the invention;

FIG. 12 is a perspective view of another embodiment of electrode embodying the invention adapted for use as an electric stimulator electrode; and FIG. 13 is a graph showing the relationship between reduction weight and current density in utilization of an electrode embodying the invention.

BEST MODE FOR CARRYING OUT THE INVENTION

Figure 1:
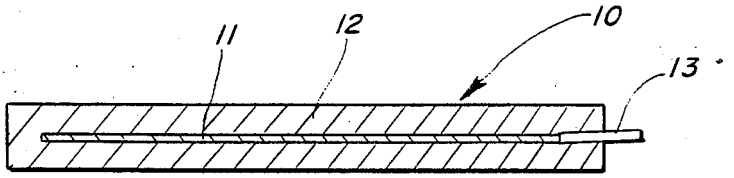
FIG. 1 is a cross section of an electrode embodying the invention.

In the illustrative embodiment of the invention as disclosed in the drawing, an elastomeric electrode generally designated 10 is shown to comprise an electrically conductive base 11 surrounded by a protective layer 12. The protective layer effectively surrounds the base so as to prevent direct contact of the base with the surrounding environment, such as the electrolyte, soil, etc., in which the electrode is used.

In the illustrated embodiment, the protective layer has a thickness in the range of approximately 0.1 to 5.0 mm.

Base 11 is formed of a fabric material, such as satin, twill, plain woven fabric with textile weave organic fiber yarns made of polyester polyamide, aromatic polyamide, etc. The fabric yarns are coated, as by deposition or chemical plating, with conductive material, such as nickel, copper, zinc, etc. Alternatively, electrically conductive elements may be provided in the yarn. Further alternatively, the fabric may comprise a metal fabric or mesh. Still further, the base may comprise a metal plate.

The surface resistance value of the electrically conductive base is preferably less than 20 ohms per square mm. Preferably, the thickness of the base is no more than approximately 10 mm.

The protective layer is formed of silicone or fluorine rubber provided with the distributed carbon or oil therein. Highly electrically conductive carbon for use in the protective layer preferably has 300 to 600 ml/100 g of DBP (absorption number), 800 to 2000 mg/g of iodine number amount and 800 to 2000 $m^2/g$ of nitrogen surface area.

Preferably, the electrically conductive carbon has a continuous chain structure with only a short distance between the particles. Examples of suitable carbon material are Ketjen black EC, manufactured by AKZO, and Printex XE-2, manufactured by Degusa.

In forming the protective layer, 10 to 30 weight parts of carbon is added to 100 parts of silicone or fluorine rubber.

The side chain of the rubber is preferably a methyl or phenyl group. Examples of such silicone rubber are methylvinylsiloxane polymer, fluorosilicone rubber introduced with $CF_2$ in its main chain, or fluorosiloxanedimethylsiloxane copolymer.

Examples of suitable fluorine rubber include vinylidenefluoride tetrafluoroethylene-propylene, fluorine-containing silicone, fluorine-containing nitrile, fluorine-containing vinylether, fluorine-containing triazine, and fluorine-containing phosphazine.

Such an elastomer composite electrode may be used for both anode and cathode applications, as it effectively prevents metal adhered to the conductive base from oxidizing or dissolving.

The protective layer is arranged to permit a terminal 13 to extend from electrical contact with the base 11 to exteriorly of the electrode, as illustrated in FIG. 1.

Figure 3:
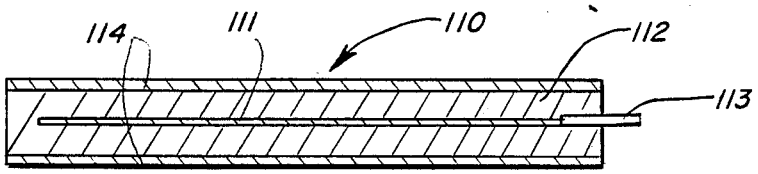
FIG. 3 is a transverse section of another form of electrode embodying the invention.
Figure 4:
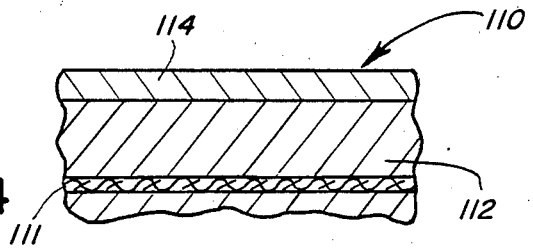
FIG. 4 is an enlarged fragmentary section illustrating a portion of the electrode of FIG. 3 in greater detail.

In FIGS. 3 and 4, a modified form of electrode embodying the invention generally designated 110 is shown to comprise an electrode generally similar to electrode 10, but wherein the protective layer 112 defines outer surface portions 114 containing antioxidative electrically conductive powder. The thickness of the surface portion 114 is preferably in the range of approximately 0.1 to 5.0 mm.

The use of conductive fabric provides for improved flexibility in the electrode.

The electrode 110 is adapted for use in water, alkaline or acidic aqueous solution, and preferably, the protective layer 112 contains highly electrically conductive carbon and oil in an elastomer of natural rubber, polybutadiene rubber, styrene-butadiene copolymer rubber, butyl rubber, chloroprene rubber, ethylene propylene copolymer rubber, and silicone rubber. The rubber preferably is a sulfur, sulfur compounds, or peroxides for cross-linking of the rubber to improve mechanical strength and heat resistance. Alternatively, the protective layer may be formed of a thermoplastic elastomer, such as SIS, SBS, and SEBS.

The protective layer 112 also contains highly electrically conductive carbon, graphite, glassy carbon, etc., in the amount of 30 to 150 parts by weight, and preferably 40 to 100 parts by weight of the carbon in 100 weight parts of the elastomer.

The carbon preferably contains 150 ml/100 g or more, and preferably 400 ml/100 g or more, of DBP oil absorption number, 100 mg/g or more of iodine number, and 150 $m^2/g$ or more of $N_2$ surface area. Illustratively, the carbon may be formed of highly electrically conductive furnace black or acetylene black.

The elastomer of the surface portion 114 may be the same as that of the protective layer 112. The antioxidative electrically conductive powder may comprise an oxide having a NaCl type structure, such as TiO, VO, NbO, EuO, etc.; a corundal oxide, such as $Ti_2O_3$, $V_2O_3$, etc.; a rutile type oxide, such as $TiO_2$, $SnO_2$, $RuO_2$, $OsO_2$, $IrO_2$, etc.; a Perovskite type oxide, such as $LaTiO_3$, $CaVO_3$, $SrVO_3$, $CaCrO_3$, $SrCrO_3$, $LaNiO_3$, $LaCuO_3$, $SrRuO_3$, $LuNiO_3$, etc.; an oxide, such as $ReO_3$ and $MxWO_3$; a Pyrochlore oxide, such as $K_2NiF_4$; a spinel oxide, such as $Fe_3O_4$, $LiTi_2O_4$, etc.; and an $MxV_2O_5$ oxide, such as beta-$MxV_2O_5$. The oxides preferably have approximately $10^{-4}$ ohm.cm, or less, resistivity at 300K with dp/dT less than 0 so as to directly deliver electrons to the surrounding electrolyte in controlling the electrolytic reaction.

Other examples of powder having suitable high antioxidation and heat resistance characteristics for use in the surface portion 114 include powder of metal boride, such as $TiB_2$, $ZrB_2$, MoB, etc.; metal silicides, such as $TiSi_2$, $WSi_2$, $NiSu_2$, $ZeSu_2$, etc.; metal nitrides, such as TiN, ZrN, etc.; and metal carbides, such as TiCX, ZrCX, $Mo_2CX$, and WC.

Preferably, the antioxidative powder is present in the amount of 50 to 1500 weight parts to 100 weight parts of the elastomer. More specifically, the antioxidative powder is present in the range of approximately 100 to 800 weight parts of powder to 100 weight parts of the elastomer.

The inclusion of the antioxidative material in the surface portion 114 preferably causes the surface portions to have 1½ to 10 times as much electrically conductive material as that of the remainder of the protective layer 112. The use of such a high amount of electrically conductive material in the layers 114 effectively assures that the surface portions are minimally oxidized.

Figure 5:
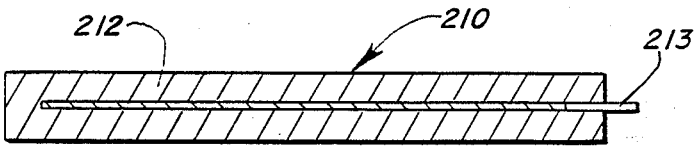
FIG. 5 is a transverse section illustrating still another electrode embodying the invention.

In FIG. 5, another modified form of electrode embodying the invention, generally designated 210 is shown to comprise an electrode generally similar to electrode 10, but wherein the antioxidative material is not provided in the form of a layer 114, but rather, is distributed throughout the protective layer 212. As in electrode 110, the antioxidative conductive powder is provided in an amount of 50 to 1500 weight parts, and preferably 100 to 800 weight parts of powder to 100 weight parts of the elastomer.

Similarly as in electrode 110, highly conductive carbon is also distributed throughout the protective layer.

The electrode of FIG. 5 is advantageously adapted for use as an anode in that the antioxidative material effectively precludes oxidation of the electrode notwithstanding the disposition thereof in an electrolyte for a long period of time. Further, the provision of the antioxidative material controls the electrolytic reaction of the electrolyte advantageously.

It has been found t hat such an electrode has a generally catalytic ability. The inclusion of an oxide, such NiO, $WO_3$, and $TiO_2$ provides photoactivation characteristics, thereby permitting the electrode to generate oxygen when used as an anode. As the chlorine overvoltage of $RuO_2$ is one-tenth or less in a saline water electrolysis than that of graphite or platinum, chlorine gas can be efficiently produced. Further, as NiO has a low hydrogen cathodic overvoltage when the electrical potential is suitably controlled, hydrogen gas can be efficiently generated with the electrode. The desired overvoltage of hydrogen, oxygen, or electrode. The desired overvoltage of hydrogen, oxygen, or chlorine may be controlled by selecting the electrically conductive antioxidative powder for efficient production of the desired gas.

In the electrode 210, as shown in FIG. 5, the protective layer includes 30 to 150 weight parts of electrically conductive powder, and preferably 40 to 100 weight parts thereof to 100 parts of the elastomer. Such an electrode may be used for both ande and cathode applications and prevents metal adhered to the conductive base material from oxidizing or dissolving, with the protective layer delivering electrons between the conductive base and the electrolyte.

Turning now to the embodiment of FIG. 7, an electrode generally designated 310 is shown to comprise an electrode generally similar to electrode 10, but being adapted for use in soil. The base 311 is embedded in a protective layer 312 similar to the base and protective layer of electrode 10. However, electrode 310 further includes an enclosing filter layer 315 made of a porous material. The filter layer is preferably not bonded to the surface of the protective layer 312. The filter prevents fine soil particles from entering therethrough, while yet permits impregnation of water to protect the surface of the protective layer and thereby activating an electrolytic reaction on the surface.

In the illustrated embodiment, the filter layer may be formed of nonwoven fabric, woven fabric, paper, and foamable material. The thickness of the filter layer 315 may be selected as desired by the user.

In FIG. 8, still another form of electrode embodying the invention, generally designated 410, is shown to comprise an electrode similar to electrode 10, but wherein the outer portion 416 of the protective layer 412 is provided with a rough, or uneven, outer surface 417. The surface portion 416 may be formed integrally with the protective layer 412 or may be formed of a different material from the protective layer 412, within the broad scope of the invention. The outer surface portion 417 is selected to have enhanced permeability whereby electrolytic reaction on the rough surface 417 is enhanced. Where the surface portion 417 comprises a separate layer, it is preferable that the surface portion 416 be readily bondable with the protective layer 412.

Still another form of electrode embodying the invention generally designated 510 is shown in FIG. 10 to comprise an electrode generally similar to electrode 10 but adapted for use in soil and including a first electrically conductive layer 516 on the outer surface of the protective layer 512. The outer surface 517 of the layer 516 is preferably rough, or uneven, and the filter layer 515 is provided on the rough outer surface 517. The electrode 510 has an increased surface area for providing improved electrolytic reaction characteristics, and the filter layer 515 effectively protects the outer surface 517 in use of the electrode in soil applications. Thus, fine soil particles are not adhered to the surface 517, while yet the electrode can maintain desirable electrolytic reaction activity as a result of the impregnation of the filter layer 515 over a period of time. Gas generated by the reaction is externally discharged from the filter layer without residue therein.

Referring now to FIG. 11, still another form of electrode, generally designated 610, embodying the invention comprises an electrode having a base 611 and a surrounding protective layer 612, similar to these elements of electrode 10. Electrode 610 is also adapted for use in soil and includes a surface portion 616 having a rough, or uneven, outer surface 617 similar to that of the surface portion 417 in electrode 410. A filter layer 615, similar to filter layer 515 of electrode 510, is provided about the surface portion 616. Electrode 610 differs from electrode 510 in the provision of an outer, rigid container 618 formed of a suitable material to prevent the electrode material from deforming under the pressure of the soil. The container is provided with a plurality of through openings 619 for passing water therethrough from the surrounding environment. In the illustrated embodiment, the container is formed of a suitable synthetic resin, ceramic, wood, etc.

In the electrodes used for soil applications, the filter layer prevents fine soil particles from adhering to the surface of the protective layer, while yet water may permeate through the filter layer for activating an electrolytic reaction on the surface of the electrode over long periods of time. Thus, the soil is separated from the electrode reaction surface while yet gas may escape from the reaction surface outwardly through the filter layer.

By providing the rough or uneven outer surface on the protective layer, the total surface area of the electrode is increased substantially so as to permit conduction of a large quantity of current so as to enhance the current efficiency of the electrode. By increasing such efficiency, lower voltages may be utilized, thereby increasing the life of the electrode and reducing electrophoresis in the charged particles in the soil surrounding the electrode. The filter layer further precludes deterioration of the outer surface portion of the electrode.

The provision of the outer container 618 in electrode 610 provides further prevention of soil particle entrance through the fabric to the outer surface of the protective layer while, at the same time, reducing possibility of damage or deformation of the electrode by the soil pressure.

Still another form of the electrode embodying the invention, generally designated 710 is illustrated in FIG.

12. The electrode 710 is adapted for use as an electrode in contact with a person's skin for electrical stimulation and the like. Electrode 710 includes a thin base 711, which is provided with an overlying reinforcing layer 720. A protective layer 712 is provided on the reinforcing layer 720. An insulating layer 721 is provided on the protective layer 712, and a terminal-inserting portion 722 is provided on the insulation layer 721 for connecting a suitable terminal (not shown) through the insulation layer 721, protective layer 712 and reinforcing layer 720 into electrical contact assocciation with the base 711.

Illustratively, the insulation layer 721 may be formed of an insulating rubber or synthetic resin.

Figure 2:
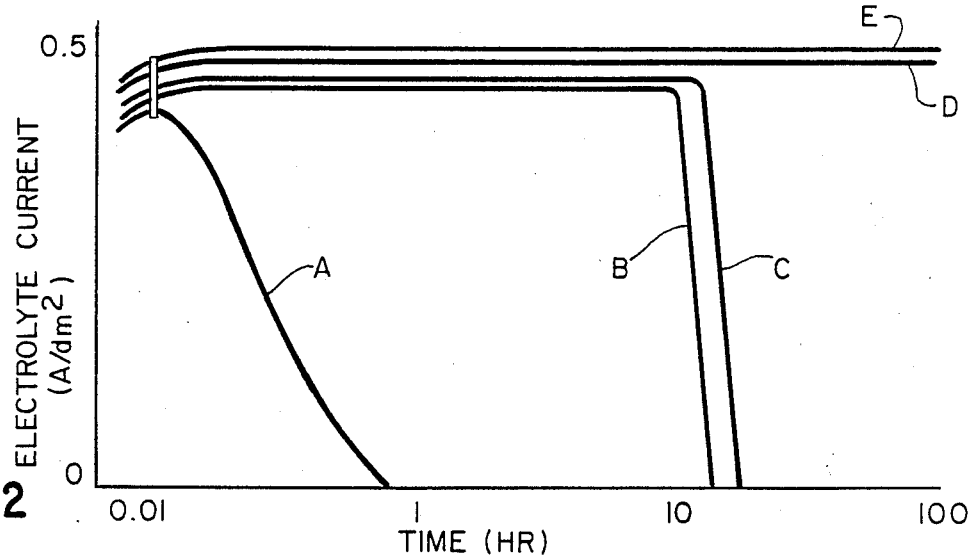
FIG. 2 is a graph illustrating the relationship between electrolytic current and time with a number of electrodes embodying the invention.

Referring to FIG. 2, the relationship between the electrolytic current and time with a number of electrodes made in accordance with the invention is shown. Five different electrodes were manufactured as follows:

Electrode materials were manufactured in accordance with the Table 1 below, identified as Compounds A, B, C, D and E. The material was mixed in a Banbury mixer and formed by roll mills to a 1 mm thickness to form two sheets. Fabric having 5 to 10 ohms/square mm of surface resistance value and adhered with approximately 13 g/m2 of nickel on a polyester material of plain woven texture was interposed between the sheets and mounted in a press and subjected to a temperature of 150° C. under pressure to vulcanize the rubber for approximately 20 minutes. The electrodes had a configuration of 300 mm length, 300 mm width, and 2 mm thickness, with the thickness of the protective layer formed on the surface of the fabric being approximately 1.0 mm.

The elastomeric electrode was mounted on a holding plate to form an anode and a platinum electrode was provided as a cathode. The electrodes were spaced at intervals of approximately 5 cm, dipped in an electrolytic bath filled with ordinary city water at approximately 20° C. A predetermined 50-volt DC voltage was applied between the electrodes to conduct an electrolytic test, and the electrolyte color and precipitate were observed, as indicated, after 10 hours thereof.

TABLE 1

| | Example | | Comparison Example | | |
|---|---|---|---|---|---|
| Compound | A | B | C | D | E |
| Silicon rubber compound (a) | 100 | 100 | | | 100 |
| Styrene isoprene Styrene (SIS) compound (b) | | | 100 | | |
| CR compound (c) | | | | 100 | |
| Ketjen black EC (d) | 20 | | 50 | 50 | 5 |
| Printex XE-2 (e) | 20 | | | | |
| Electrolyte color ° | Trans-parent | Trans-parent | Yellow | Yellow | Trans-parent |
| Precipitate in liquid | none | none | Black | Black | none |
| Maximum current density (A/dm$^2$) | 10–30 | 10–30 | 0.5–1 | 0.5–1 | 0.01–0.1 |

(a) PHONE. POULENC
(b) 100 wt. parts of SIS*A, 20 wt. parts of process oil
(c) 100 wt. parts of CR, 2 wt. parts of stearic acid, 4 wt. parts of MgO, 2 wt. parts of antioxidant O D-3, 0.5 wt. parts of ethylenethiourea, 5 wt. parts of ZnO, 20 wt. parts of process oil
(d) AKZO
(e) Degussa 1 Normal KCl was dissolved in ion exchange water as an electrolyte, and the electrodes were introduced therein at an interval of approximately 5 cm. Voltages were applied and electrolysis occurred for 1 hour. When the electrolytic current stabilized and no contamination appeared to occur in the liquid, the voltage was further raised. When current drop and contamination of the liquid were observed within 1 hour, the current flowing at the previous voltage was held at the maximum current density. The results are listed in the above Table.

The results shown in FIG. 2 indicate that the elastomeric electrodes of this invention provide an improved electrode construction wherein electrolytic discolor and contamination are eliminated. Over long periods of time, the electrolytic current was stabilized and an increase in the maximum current density was permitted. The electrodes did not cause oxidation of the surface and provided excellent corrosion resistance, so that the electrodes could be used in an electrolytic bath or soil for long useful life.

Referring now to FIG. 6, another graph showing the relationship between electrolytic current and time for five different rubber mixtures is shown. The rubber material shown in Table 1 was mixed in a Banbury mixer and was formed by roll mills to have a 1 mm thickness in two sheets. One sheet was coated with rubber paste listed in Table 2 herefollowing to provide a surface layer on the surface of the protective layer.

TABLE 2

| Compound X | (wt. parts) | Compound Y | (wt. parts) |
|---|---|---|---|
| Styrene isoprene styrene (SIS) *1 | 100 | CR | 100 |
| | | Stearic Acid | 2 |
| | | Ketjen black EC | 50 |
| Process oil | 20 | MgO | 4 |
| | | Antioxidant nonflex O D-3 | 2 |
| | | Ethylene thiourea | 0.5 |
| Ketjen black EC *2 | 60 | ZnO | 5 |
| | | Process Oil | 20 |

*1 Kraton D-1112 (manufactured by Shell Chemical)
*2 AKZO

Fabric having 5 to 10 ohms/square mm surface resistance value was adhered with approximately 13 g/m2 of nickel on polyester fabric of plain woven texture being interposed between the sheets. The laminate was then mounted in a press and heated to a temperature of 150° C. under pressure to vulcanize the rubber for approximately 20 minutes in forming the example electrodes.

The electrodes had a 2 mm thickness, 300 mm width, and 300 mm length, with the thickness of the protective layer formed on the surface of the fabric being approximately 1.0 mm, and the thickness of the surface layer provided on one surface of the layer was 0.1 mm.

The elastomeric electrodes were mounted on a holding plate to form an anode, and a platinum electrode was provided as a cathode. The electrodes were spaced at an interval of approximately 5 cm, dipped in an electrolytic bath filled with city water at approximately 20° C., with a predetermined voltage of 50 volts direct current applied to conduct an electrolytic test therewith. The electrolyte color and contaminants were observed after 3 hours of operation. The electrolyte was also tested for nickel concentration (ppm) by an atomic absorption method, and the results of the test are shown relative to the electrodes F, G, H, I and J in Table 3 herefollowing. are shown relative to the electrodes F. G. H. I and J in Table 3 below:

TABLE 3

| | Example | | | | Comparison Example | | | |
|---|---|---|---|---|---|---|---|---|
| | F | G | H | I | J | K | L | M |
| Electric conductive base material | Ni-plate fabric | Ni-plate fabric | Ni-plate fabric | Ni-plate fabric | Ni-plate fabric | Copper plate | Ni-plate fabric | Ni-plate fabric |
| Protective layer | Compound X | Compound X | Compound Y | Compound Y | Compound Y | — | Compound S | Compound T |
| Rubber compound of surface layer (wt. parts) | | | | | | | | |
| SIS | 100 | 100 | | | | | | |
| CR | | | 100 | 100 | 100 | | | |
| Ketjen black EC | 200 | | 200 | | | | | |
| $SnO_2$ | | 300 | | 300 | | | | |
| $NiO.FeO_3$ | | | | | 300 | | | |
| Electrolyte color | Colorless | Colorless | Colorless | Colorless | Colorless | Blue | Yellow | Yellow |
| Electrolyte contamination (floats) | None | None | None | None | None | Blue colloid | White yellow colloidal | White yellow colloidal |
| Ni concentration of electrolyte (ppm) | 0.05 | 0.09 | 0.06 | 0.10 | 0.08 | | 47.2 | 55.2 |

TABLE 4

| | Compound S (wt. parts) | Compound T (wt. parts) |
|---|---|---|
| SIS | | 100 |
| CR | 100 | |
| Stearic acid | 2 | |
| Carbon black (MRF) | 40 | 40 |
| MgO | 4 | |
| Antioxidant nonflex O D-3 | 2 | |
| Ethylenethiourea | 0.5 | |
| ZnO | 5 | |
| Process Oil | 20 | 20 |

Comparison examples were prepared and tested, as shown in Table 3. In Comparison Example K, a copper plate was used as an electrode. In Comparison Example L, rubber was mixed in a Banbury mixer, with the Compound S described in Table 4. The mixture was formed by roll mills to sheets each having 2 mm of thickness and the sheets were interposed between conductive fabric similar to that of the Examples F, G, H, I, and J. The laminate was mounted in a press at 150° C., pressurized and vulcanized for approximately 20 minutes to manufacture a plurality of electrodes. Each electrode had a length of 300 mm, a width of 300 mm, and a thickness of 2 mm. The film formed on the conductive fabric was varied by pressing pressure to approximately 100 microns of thickness.

The Comparison Example M utilized the Compound T described in Table 4 and was, in all other respects, similar to the Comparison Example L.

These additional electrodes were tested, with the results also shown in Table 3.

The results for Examples F, G, and H and Comparison Examples M are shown graphically in FIG. 6.

Two additional examples were formed as above using nickel-adhered electrically conductive fabric interposed between the sheets. Tests were run similar to those described with Examples F, G, H, I, and J, and the electrolyte color, contamination and nickel concentration were measured. The results of these tests are shown in the following Table 5.

TABLE 5

| | Example N | Example O |
|---|---|---|
| Electric conductive base material | Ni-plate fabric | Ni-plate fabric |
| Protective layer | Compound A | Compound B |
| Electrolyte color | Colorless | Colorless |
| Electrolyte contamination | None | None |
| Ni concentration of electrolyte (ppm) | 0.05 | 0.11 |

These tests also show that the improved electrodes of the present invention effectively avoid electrolyte discolor and contamination. Over a long period of time, the electrolytic current value was stabilized, and the surface of the electrode was not oxidized, while providing excellent corrosion resistance so that the electrode may be used in electrolytic bath application for long, useful life.

The invention comprehends that the base be provided in a protective layer which prevents metal of the conductive base material from oxidizing and dissolving. The protective layer delivers electrons between the conductive base and the electrolyte, while providing a highly flexible electrode.

The surface layer filled with antioxidative conductive powder, or other highly conductive material, delivers electrons directly to the electrolyte, thereby preventing oxidation of the protective layer. Again, the electrode is provided with enhanced long, troublefree life, with the improved construction thereof. The use of the antioxidative surface portion of the electrode provides controlled electrolytic reaction, thereby efficiently generating gas.

As another example of electrode manufactured in accordance with the invention, 100 parts of SIS compound (Kraton D1111 manufactured by the Shell Chemical Co.) was mixed with 80 parts of acetylene black and NT-100 oil (cyclic fatty series manufactured by Fuji Kosan Co.). The material was mixed in a Banbury mixer and formed by roll mills to 100 mm of thickness to form 2 sheets. Fabric having 5 to 10 ohms/square mm of surface resistance value was adhered with approximately 13 $g/m_2$ of nickel on polyester fabric of plain woven texture was interposed between the sheets. The laminate was mounted in a press and heated at 150° C. under pressure to vulcanize the rubber for approximately 20 minutes in forming the electrode. The electrode (Sample 1) had a length of 135 mm, a width of 75 mm, and a thickness of 15 mm, with a protective layer formed on the surface of the fabric having a thickness of approximately 1.0 mm. Felt material (320 $mg/cm^2$), having a thickness of 3 mm, was wound on the surface of the vulcanized material to obtain an electrode plate for use in soil, having a structure similar to that shown in FIG. 7 of the drawing.

Another example was manufactured from conductive urethane foam manufactured by Hayashi Felt, of Japan, made of continuous cell foams of 3 mm thickness, which was bonded with adhesive-electrically conductive rubber paste on the surface of the electrically conductive material of the above electrode to obtain an electrode for use in soil applicacations similar to the electrode shown in FIG. 9.

Another example electrode was formed by providing felt 320 mg/cm$^2$ of 3 mm thickness wound on the surface of the above electrode to obtain a modified form of electrode suitable for use in soil, having a structure similar to that shown in FIG. 10.

Another example was manufactured as an electrode similar to that of the electrode shown in FIG. 10 discussed above, and mounted in a polyacrylate housing having through holes of 1 mm diameter for use as a soil electrode, as shown in FIG. 11.

The electrodes were inserted into soil containing 40 parts by weight of water to 100 parts by weight of dry soil, with the interval between electrode plates being 50 mm. A current of 15 mADC/cm$^2$ was applied thereto and the time from the initial voltage increases up to 20 volts (stabilization conduction time) was measured. The results are listed in the Table 6 below.

TABLE 6

| Electrode plate | Stabilizing conducting time (hr) |
|---|---|
| Sample 1 (Comparison Example) | 5 |
| Sample 2 (FIG. 7) | 28 |
| Sample 3 (FIG. 9) | 9 |
| Sample 4 (FIG. 10) | 62 |
| Sample 5 (FIG. 11) | 94 |

As shown in Table 6, the electrodes for soil application embodying the invention lengthen the stabilization conduction time as compared with conventional electrodes. The electrodes covered with the filter layer and the electrodes provided with the filter layer and an outer enclosure further increases the stabilization conduction time, whereby long troublefree life of the electrode is obtained.

As discussed above, the filter layer prevents fine particles in the soil from entering into engagement with the surface of the protective layer, while yet permitting permeability of the water to the electrolyts reacting surface thereof. Thus, the terminals permit electrolytic reaction on the surface for a long period of time maintaining stable conduction times. Where the protective layer have an uneven surface is provided in the electrode material, the surface area of the electrode is substantially increased, permitting increased levels of current in use, thereby raising the current efficiency. The housing was found to protect the electrode material against deformation and further stabilizes the conduction time over a long period of time.

A rubber insulating layer, manufactured by Mitsuboshi Belting Ltd., was bonded to one surface of an elastomeric electrode of the construction described in Example A above. The rubber insulating layer had self-adhesiveness and had a thickness of 1 mm. An electrolytic corrosion resistant elastomer electrode was formed therefrom to have 1 mm thickness, 100 mm width, and 200 mm length. This electrode was bonded to a steel plate through an insulating layer dipped in 1% aqueous sulfuric acid solution. The elastomeric electrode was used as an anode and the steel plate was used as a cathode. A predetermined cathode current was fed for a predetermined time between the electrodes and the reduction in weight of the steel plate due to the corrosion was measured. The results are shown in FIG. 13. As shown therein, when the current density becomes 0.20 mA/cm$^2$ or larger, the corrosion amount of the steel plate was largely reduced.

The foregoing disclosure of specific embodiments is illustrative of the inventive concepts comprehended by the invention.

We claim:

1. A flexible electrode comprising:

an electrically conductive flexible base;

a flexible protective layer having a substantial thickness completely about and enclosing said base, said protective layer formed of an elastomeric material selected from the group of silicone rubbers and fluorine rubbers, said protective layer having electrically conductive material selected from the group consisting of highly conductive carbon black, graphite, and glassy carbon distributed therein, said electrically conductive material being present in the amount of 10 to 30 parts by weight to 100 parts by weight of the elastomeric material, said protective layer being heated and pressurized on said base for a time sufficient to vulcanize said elastomeric material while still resulting in substantial flexibility of said electrode; and an electrically conductive terminal extending from said base to exteriorly of said protective layer.

2. The electrode of claim 1 wherein said conductive material in said protective layer further includes antioxidative conductive powder distributed therein.

3. The electrode of claim 1 wherein said electrically conductive material contains 300–600 ml/100 g of DBP absorption number, 800–2000 mg/g of iodine number amount and 800–2000 m$^2$/g of nitrogen surface area.

4. The electrode of claim 1 wherein said elastomeric material comprises rubber having a methyl group side chain.

5. The electrode of claim 1 wherein said elastomeric material comprises rubber having a phenyl group side chain.

6. The electrode of claim 1 wherein said elastomeric material comprises silicone rubber containing methylvinylsiloxane polymer.

7. The electrode of claim 1 wherein said elastomeric material comprises fluorosilicone rubber.

8. The electrode of claim 1 wherein said elastomeric material comprises fluorosilicone rubber having a main chain of $CF_2$.

9. The electrode of claim 1 wherein said elastomeric material comprises silicone rubber containing fluorosiloxane dimethylsiloxane copolymer.

10. The electrode of claim 1 wherein said elastomeric material comprises fluorine rubber containing vinylidenefluoride.

11. The electrode of claim 1 wherein said elastomeric material comprises fluorine rubber containing tetrafluoroethylene-proyplene.

12. The electrode of claim 1 wherein said elastomeric material comprises fluorine rubber containing fluorine-containing nitrile.

13. The electrode of claim 1 wherein said elastomeric material comprises fluorine rubber containing fluorine-containing vinylether.

14. The electrode of claim 1 wherein said elastomeric material comprises fluorine rubber containing fluorine-containing triazine.

15. The electrode of claim 1 wherein said elastomeric material comprises fluorine rubber containing fluorine-containing phosphazine.

16. The electrode of claim 1 wherein the thickness of the protective layer is approximately 0.1 to 5.0 mm.

17. The electrode of claim 1 wherein said base is formed of fabric.

18. The electrode of claim 1 wherein said base is formed of material selected from the group consisting of metal-coated satin, twill, woven fabric, metal-coated yarns and metal yarns.

19. The electrode of claim 18 wherein said base is formed of a fabric formed of metal-coated synthetic resin yarns.

20. The electrode of claim 1 wherein said base is formed of metal mesh.

21. The electrode of claim 1 wherein said base comprises a material having a surface resistance no greater than approximately 20 ohms/square mm.

22. The electrode of claim 1 wherein said base has a thickness of no greater than 10 mm.

23. A flexible electrode comprising:

an electrically conductive flexible base;

a flexible protective layer having a substantial thickness completely about and enclosing said base, said protective layer formed of an elastomeric material selected from the group consisting of silicone and fluorine rubbers, said protective layer having electrically conductive material therein. said protective layer further having an elastomer surface portion having antioxidative material distributed therein, said antioxidative material being present in the amount of 50 to 1500 weight parts to 100 weight parts of the elastomer, said protective layer being heated and pressurized on said base for a time sufficient to vulcanize said elastoal being present in the amount of 10–30 parts by weight to 100 parts by weight of the elastomeric material, said protective layer being heated and pressurized on said base for a time sufficient to vulcanize said elastomeric material while still resulting in substantial flexibility of said electrode;

a filter layer formed of a porous material covering said protective layer; and an electrically conductive terminal extending from said base to exteriorly of said filter layer.

24. The electrode of claim 23 wherein said antioxidative material is at least one selected from the group consisting of TiO, VO, NbO, EuO, $ReO_3$, $MxWO_3$, corundal oxides, rutile type oxides, Perovskite-type oxides, Pyrochlore oxides, spinel oxides, $MxV_2O_5$ oxides, metal borides selected from the group consisting of $TiB_2$, $ZrB_2$, MoB, and WB, silicides selected from the group consisting of $TiSi_2$, $WSi_2$, $MoSi_2$, and $ZrSi_2$, metal nitrides selected from the group consisting of TiN and ZrN, and metal carbides selected from the group consisting of TiC, ZrC, $Mo_2C$, and WC.

25. The electrode of claim 23 wherein said antioxidative material is present in an amount of 100 to 800 weight parts to 100 weight parts of the elastomer.

26. The electrode of claim 23 further including an outer rigid housing having openings therethrough.

27. The electrode of claim 23 further including a filter layer enclosing said protective layer.

28. The electrode of claim 23 wherein said protective layer has an uneven outer surface.

29. The electrode of claim 23 wherein said antioxidative powder is present in a weight part per 100 weight parts of elastomer greater than that of said electrically conductive material.

30. The electrode of claim 29 wherein said antioxidative powder is present in a weight part per 100 weight parts of elastomer 1½ to 10 times that of said electrically conductive material.

31. A flexible electrode comprising:

an electrically conductive flexible base;

a flexible protective layer completely enclosing said base, said protective layer having a substantial thickness about said base, said protective layer formed of an elastomeric material selected from the group of silicone and fluorine rubbers, said elastomeric material having a electrically. conductive material selected from the group consisting of highly conductive carbon black, graphite, and glassy carbon distributed therein, said electrically conductive material being present in the amount of 10–30 parts by weight to 100 parts by weight of the elastomeric material, said protective layer being heated and pressurized on said base for a time sufficient to vulcanize said elastomeric material while still resulting in substantial flexibility of said electrode;

a filter layer formed of a porous material covering said protective layer; and an electrically conductive terminal extending from said base to exteriorly of said filter layer.

32. The electrode of claim 31 further including an outer housing having a through opening therein.

* * * * *